US011253871B2

(12) United States Patent
Kang et al.

(10) Patent No.: US 11,253,871 B2
(45) Date of Patent: Feb. 22, 2022

(54) ELECTROSTATIC PRECIPITATOR INTEGRATED WITH DOUBLE-SKIN FACADE OF BUILDING

(71) Applicants: University of Seoul Industry Cooperation Foundation, Seoul (KR); Kyungil University Industry-Academic Cooperation, Gyeongsangbuk-do (KR)

(72) Inventors: Dong Hwa Kang, Seoul (KR); Dong Hee Choi, Daegu (KR); Ye Seul Eom, Gyeonggi-do (KR)

(73) Assignees: UNIVERSITY OF SEOUL INDUSTRY COOPERATION Foundation, Seoul (KR); KYUNGIL UNIVERSITY INDUSTRY-ACADEMIC COOPERATION, Gyeongsangbuk-Do (KR)

( * ) Notice: Subject to any disclaimer, the term of this patent is extended or adjusted under 35 U.S.C. 154(b) by 248 days.

(21) Appl. No.: 16/692,474

(22) Filed: Nov. 22, 2019

(65) Prior Publication Data

US 2020/0164384 A1 May 28, 2020

(30) Foreign Application Priority Data

Nov. 23, 2018 (KR) ..... 10-2018-0146592

(51) Int. Cl.

| | |
|---|---|
| ***B03C 3/36*** | (2006.01) |
| ***B03C 3/08*** | (2006.01) |
| ***B03C 3/47*** | (2006.01) |
| ***B03C 3/41*** | (2006.01) |
| ***E06B 7/086*** | (2006.01) |
| *E06B 7/02* | (2006.01) |

(52) U.S. Cl.

CPC ..... *B03C 3/368* (2013.01); *B03C 3/08* (2013.01); *B03C 3/41* (2013.01); *B03C 3/47* (2013.01); *E06B 7/086* (2013.01); *B03C 2201/04* (2013.01); *E06B 2007/026* (2013.01)

(58) Field of Classification Search

CPC combination set(s) only.
See application file for complete search history.

(56) References Cited

FOREIGN PATENT DOCUMENTS

| | | | |
|---|---|---|---|
| JP | 2016087598 A | * | 5/2016 |
| KR | 20060036177 | | 5/2006 |
| KR | 20110073077 | | 6/2011 |

* cited by examiner

*Primary Examiner* — Christopher P Jones
*Assistant Examiner* — Sonji Turner
(74) *Attorney, Agent, or Firm* — IPLA P.A.

(57) ABSTRACT

An electrostatic precipitator integrated with a double-skin facade of a building, includes: an outer window installed at an outdoor side of the building; an outer upper opening and an outer lower opening installed at upper and lower portions, respectively, of the outer window for indoor ventilation; an inner window providing a hollow layer between the inner window and the outer window by being installed at a room side facing the outer window; an inner upper opening and an inner lower opening installed at upper and lower portions, respectively, of the inner window for ventilation; at least one discharge electrode charging particles introduced into the hollow layer through the outer lower opening by being installed in the hollow layer; and dust collecting electrodes precipitating charged particles by being installed in contact with the hollow layer.

5 Claims, 5 Drawing Sheets

ELECTROSTATIC PRECIPITATOR INTEGRATED WITH DOUBLE-SKIN FACADE OF BUILDING

CROSS REFERENCE

The present application claims priority to Korean Patent Application No. 10-2018-0146592, filed 23 Nov. 2018, the entire contents of which is incorporated herein for all purposes by this reference.

BACKGROUND

The present invention relates to an electrostatic precipitator for a double-skin facade of a building and, more particularly, to an electrostatic precipitator integrated with a double-skin facade of a building capable of generating a ventilation flow inside a hollow layer of the double-skin facade of the building and electrically precipitating fine dust at the same time.

Recently, there is a need for a ventilation system that not only provides a comfortable indoor environment by introducing fresh outside air but also performs proper ventilation according to a concentration of outdoor pollutants. In particular, residential ventilation is required in order to cope with fine dust in a residential building adopting natural ventilation, so research on systems that may be applied to an outer skin and windows of the residential building has been continuously conducted. However, in the existing research, a mechanical ventilation system applying a filtration filter with a large pressure loss has been mainly developed, thereby inducing a limitation that the system is applied only to a building that uses mechanical ventilation. Accordingly, research is limited in regard to a system that may remove the fine dust architecturally using natural ventilation.

Meanwhile, a double-skin system applied to a building is a system in which two skins of an inner side and an outer side are made of glass and is allowed to actively respond to changes in the external environment by providing a hollow layer, which is a thermal buffer space where ventilation is possible between the skins of the inner side and the outer side. The hollow layer may reduce a heating load by providing a thermal buffer in the winter and is utilized as a means to provide ventilation in the summer.

However, recently, fine dust frequently appears due to industrial environmental factors. The fine dust is an air pollutant containing sulfurous acid gas, nitrogen oxides, lead, ozone, carbon monoxide, and the like, and is known to induce various respiratory diseases and skin diseases and to reduce immune functions to the human body.

Therefore, there is a need for a system that may block an inflow of the fine dust into a building and, especially into a room where windows are installed. Specifically, in the case of a double-skin facade of a building, the effects of high insulation, reduction of heating and cooling load, and insulation of sound are great, but a system capable of blocking the inflow of the fine dust while performing ventilation is further needed.

As a document of related arts of the present invention, Korean Patent No. 10-1141922, "Double skin facade feasible for natural lighting" has been proposed. The above-mentioned related art constructs a skin facade of a building in a double-skin facade structure of an outer skin facade and an inner skin facade, wherein the skin facade of a building is installed at an opening of the building provided in contact with outside air, whereby natural lighting is maximized by allowing daylight illumination of places near or far from the inner skin facade to be uniform.

As another document of related arts of the present invention, Korean Patent No. 10-0655086, "Functional double-skin facades for natural ventilation" has been proposed. In the another related art, the double window structure, installed in an opening of a building provided in contact with outside air, is classified into an inner window and an outer window separated from each other. Then, the inner window and the outer window are completed as a double-skin facade structure through changing of an opening area and an opening and closing method in various ways. Furthermore, while maximizing the natural ventilation effect according to the changes in solar radiation quantity and outdoor conditions, the double window structure allows the windows to be able to be open even in bad weather, thereby enabling natural ventilation to be induced.

However, the above-mentioned related art technologies have a problem that the fine dust may not be precipitated during ventilation.

Meanwhile, the foregoing is intended merely to aid in the understanding of the background of the present invention, and is not intended to mean that the present invention falls within the purview of the related art that is already known to those skilled in the art.

Documents of Related Art

Patent Document 1: Korean Patent No. 10-1141922
Patent Document 2: Korean Patent No. 10-0655086

SUMMARY OF THE INVENTION

Accordingly, the present invention has been made keeping in mind the above problems occurring in the related art, and an objective of the present invention is to provide an electrostatic precipitator integrated with a double-skin facade of a building capable of generating a ventilation flow inside a hollow layer of the double-skin facade of the building and electrically precipitating fine dust at the same time.

In order to achieve the above objective according to an appropriate embodiment of the present invention, there may be provided an electrostatic precipitator integrated with a double-skin facade of a building, the electrostatic precipitator including: an outer window installed at an outdoor side of the building by being made of an outer glass window frame and an outer glass; an outer upper opening and an outer lower opening installed at upper and lower portions, respectively, of the outer window for indoor ventilation; an inner window providing a hollow layer between the inner window and the outer window by being installed at a room side facing the outer window at a regular interval by being made of an inner glass window frame and an inner glass; an inner upper opening and an inner lower opening installed at upper and lower portions, respectively, of the inner window, for ventilation; at least one discharge electrode charging particles introduced into the hollow layer through the outer lower opening by being installed in the hollow layer and by being controlled to an appropriate voltage strength according to external wind pressure and fine dust concentration; and dust collecting electrodes precipitating charged particles by being installed in contact with the hollow layer on surfaces, respectively, of the outer glass and the inner glass.

In addition, the electrostatic precipitator may further include: a first opening and closing blade rotatably installed in the outer lower opening, thereby allowing an amount of opening of the outer lower opening to be adjusted and a first servo motor adjusting an amount of opening of the outer lower opening by operating the first opening and closing blade to rotate; a second opening and closing blade rotatably installed in the outer upper opening, thereby allowing an amount of opening of the outer upper opening to be adjusted and a second servo motor adjusting an amount of opening of the second opening and closing blade; a third opening and closing blade rotatably installed on the inner lower opening, thereby allowing an amount of opening of the inner lower opening to be adjusted and a third servo motor adjusting opening and closing and an amount of rotation of the third opening and closing blade; a fourth opening and closing blade rotatably installed on the inner upper opening, thereby allowing an amount of opening of the inner upper opening to be adjusted and a fourth servo motor adjusting opening and closing and an amount of rotation of the fourth opening and closing blade; and a controller, in an electrostatic precipitation mode, allowing precipitation ventilation to be realized due to ascending air current generated in the hollow layer, by closing the outer upper opening and the inner lower opening by controlling driving of the second and third servo motors to operate the second and third opening and closing blades to rotate and, at the same time, by opening the outer lower opening and the inner upper opening by controlling driving of the first and fourth servo motors to operate the first and fourth opening and closing blades to rotate and allowing precipitation to be realized on dust collecting electrodes by causing a high voltage to be generated at the discharge electrode.

In addition, in a general ventilation mode, the controller may stop discharge of the discharge electrode and allow the outer upper opening and the inner lower opening to be fully opened by opening the closed second and third opening and closing blades by controlling driving of the second and third servo motors.

In addition, the controller may be connected to a fine dust concentration measurement sensor measuring concentration of external fine dust and executes the electrostatic precipitation mode when the concentration equal to or higher than a predetermined concentration is confirmed.

In addition, the discharge electrode may be provided in plural, the plurality of discharge electrodes being installed adjacent to the outer lower opening and in parallel with each other.

As described above, the electrostatic precipitator integrated with the double-skin facade of the building of the present invention can adjust an opening and a closing area of an outer upper opening, an outer lower opening, an inner upper opening, and an inner lower opening, thereby controlling ventilation and speed thereof in the hollow layer, and can electrically precipitate the fine dust by a discharge electrode, installed in the ventilation flow, and dust collecting electrodes.

BRIEF DESCRIPTION OF THE DRAWINGS

The above and other objectives, features and other advantages of the present invention will be more clearly understood from the following detailed description when taken in conjunction with the accompanying drawings. As the accompanying drawings illustrate a preferred embodiment of the present invention and, together with the detailed description of the present invention, play a role in making the technical spirit of the present invention be further understood, the present invention should not be interpreted to be limited only to the matter described in the drawings.

DETAILED DESCRIPTION OF THE INVENTION

Figure 1:
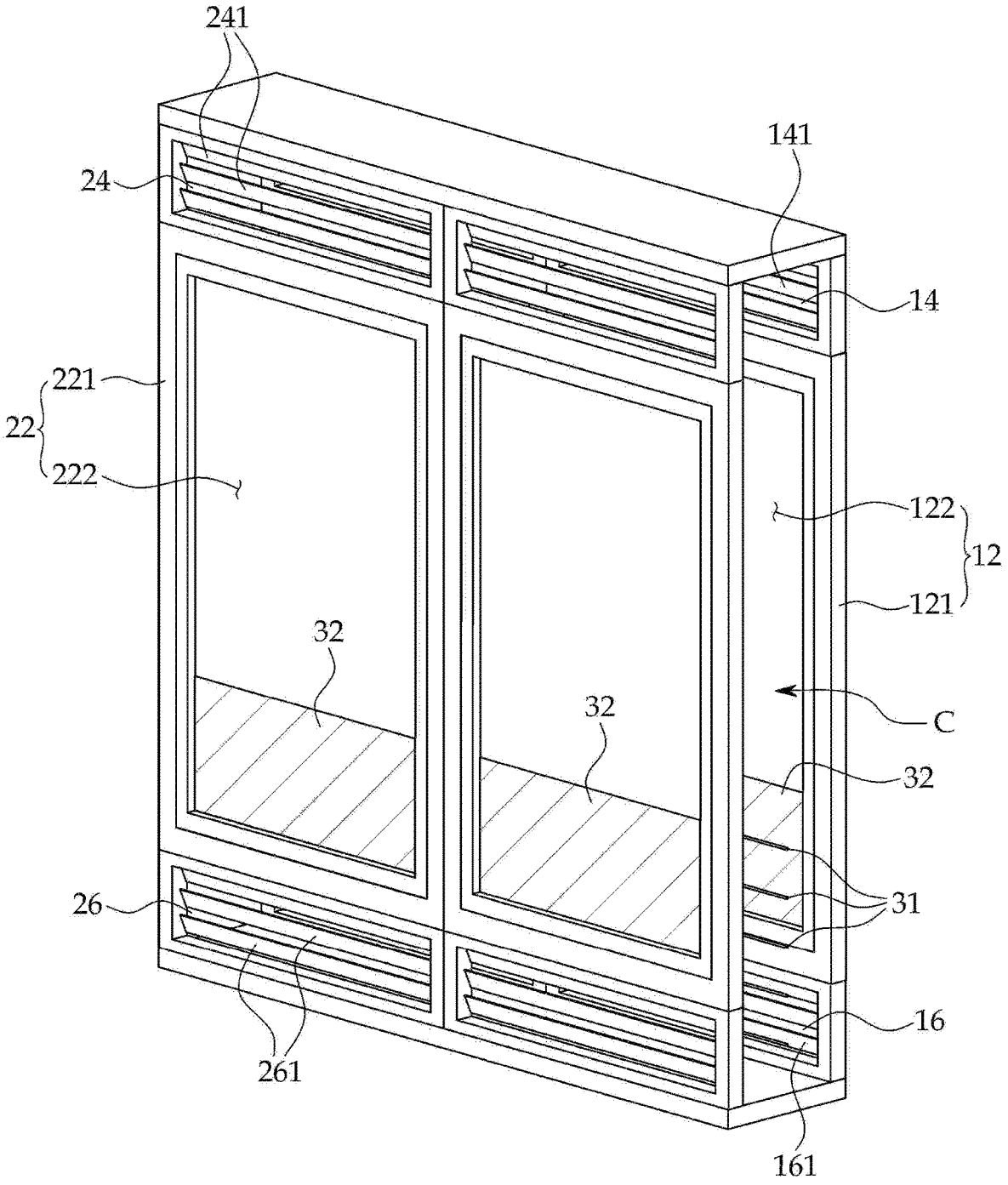
FIG. 1 is a perspective view of a double-skin facade of a building applied with an electrostatic precipitator according to the present invention.

Hereinbelow, the present invention will be described in detail with reference to embodiments proposed in the accompanying drawings, but the embodiments presented are exemplary for a clear understanding of the invention and the present invention is not limited hereto. Throughout the drawings, the same reference numerals will refer to the same or like parts.

Figure 2:
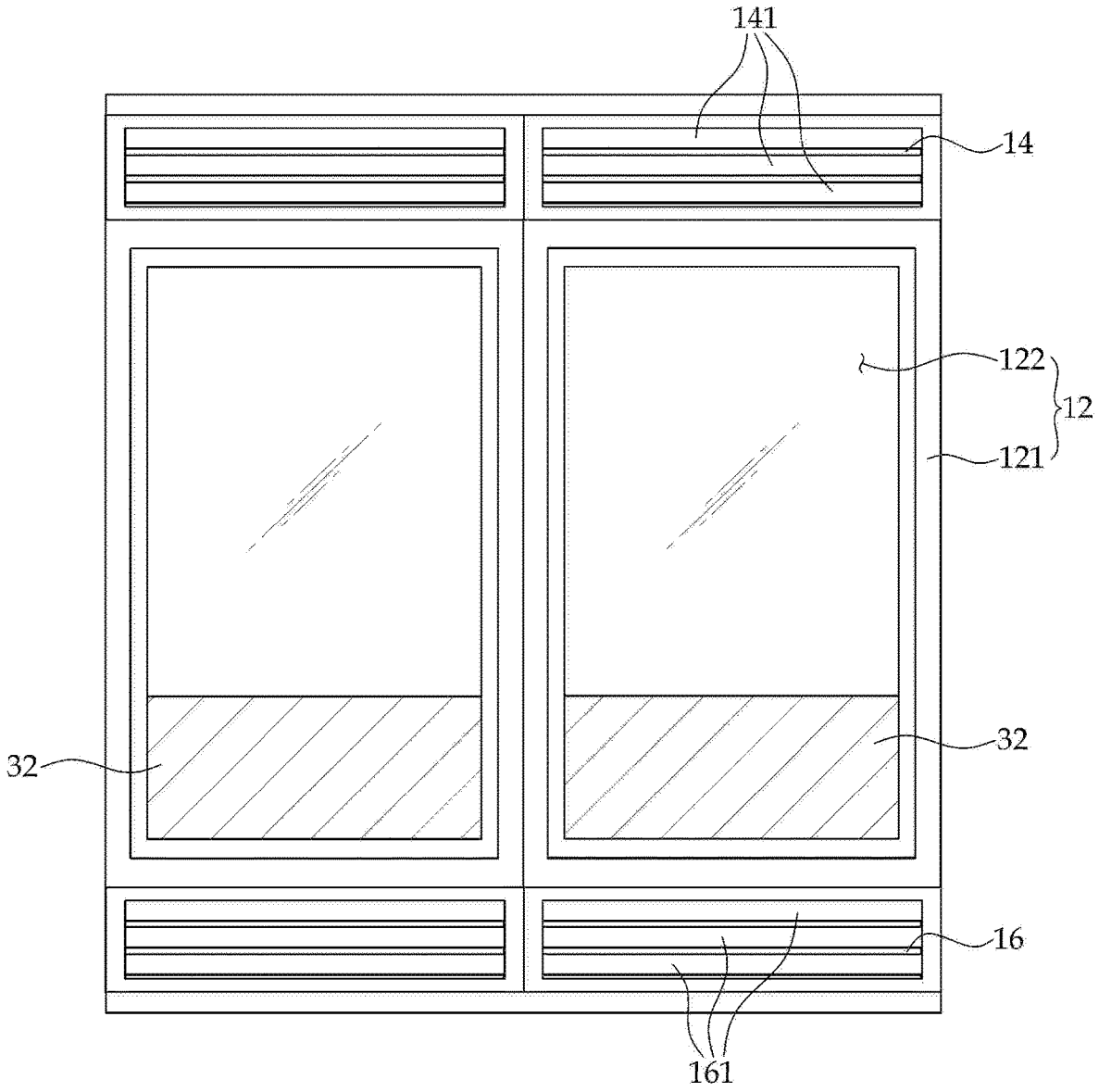
FIG. 2 is a front view of FIG. 1.
Figure 3:
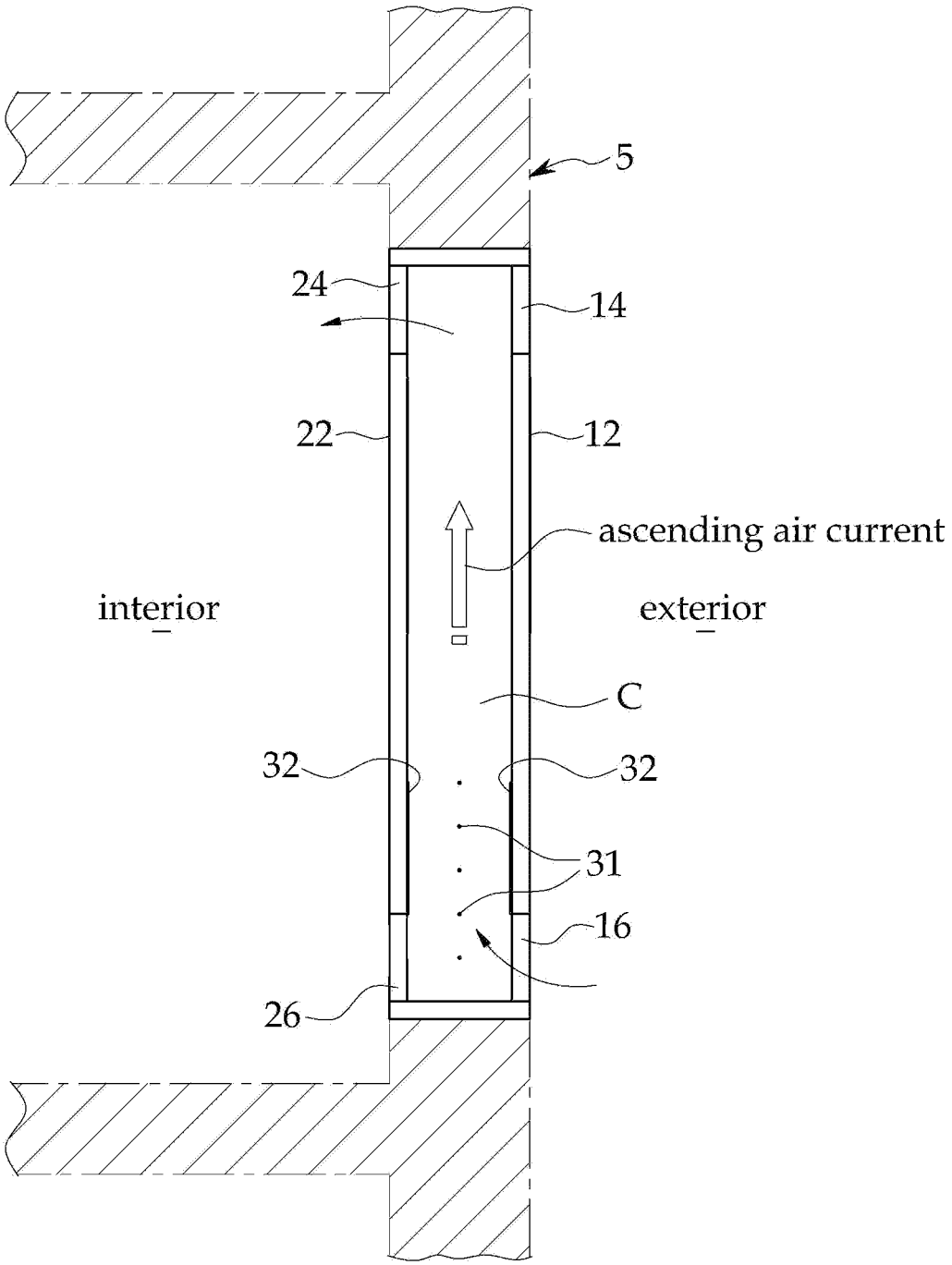
FIG. 3 is a view of a ventilation state in an electrostatic precipitation mode in the double-skin facade of the building of FIG. 1.

In an electrostatic precipitator integrated with a double-skin facade of a building according to a present embodiment, as shown in FIGS. 1 to 3, an outer window 12 made of an outer glass window frame 121 and an outer glass 122 is installed at an outdoor side of the building. In addition, an outer upper opening 14 and an outer lower opening 16 are installed at upper and lower portions, respectively, of the outer window 12 for indoor ventilation of the building. The outer glass 122 is installed by being divided into two in the present embodiment, but is not limited hereto and may be installed into a single unit or installed by being divided into at least two.

An inner window 22 is installed at a room side facing the outer window 12 at a regular interval. Here, the inner window 22 provides a hollow layer C between the inner window (22) and the outer window (12). In addition, the inner window 22 is made of an inner glass window frame 221 and an inner glass 222. The inner glass 222 is installed by being divided into two in the present embodiment, but is not limited hereto and may be installed into a single unit or installed by being divided into at least two.

Therefore, in the interior, the external view may be observed through the transparent inner glass 222 and outer glass 122.

An inner upper opening 24 and an inner lower opening 26 are installed at upper and lower portions, respectively, of the inner window 22 for indoor ventilation of the building.

Here, the outer upper opening 14, the outer lower opening 16, the inner upper opening 24, and the inner lower opening 26 may be each used as an inlet or outlet according to the seasonal opening operation method.

At least one discharge electrode 31 is installed in the hollow layer C. Here, the discharge electrode 31 may be controlled to an appropriate voltage strength according to external wind pressure and fine dust concentration. Then, the discharge electrode 31 performs a function of charging particles introduced into the hollow layer C through the outer lower opening 16. Therefore, the discharge electrode 31 may be installed adjacent to the outer lower opening 16 to charge initial particles introduced into the hollow layer C. In this case, a plurality of discharge electrodes 31 may be installed in parallel with each other for charging efficiency of the particles.

Dust collecting electrodes 32 which precipitate the particles charged by the discharge electrode 31 are provided. The dust collecting electrodes 32 may be installed in contact with the hollow layer C on surfaces, respectively, of the outer glass 122 and the inner glass 222. Therefore, as shown in the present embodiment, the discharge electrode 31 is positioned between the dust collecting electrodes 32 and 32 facing each other.

Figure 5:
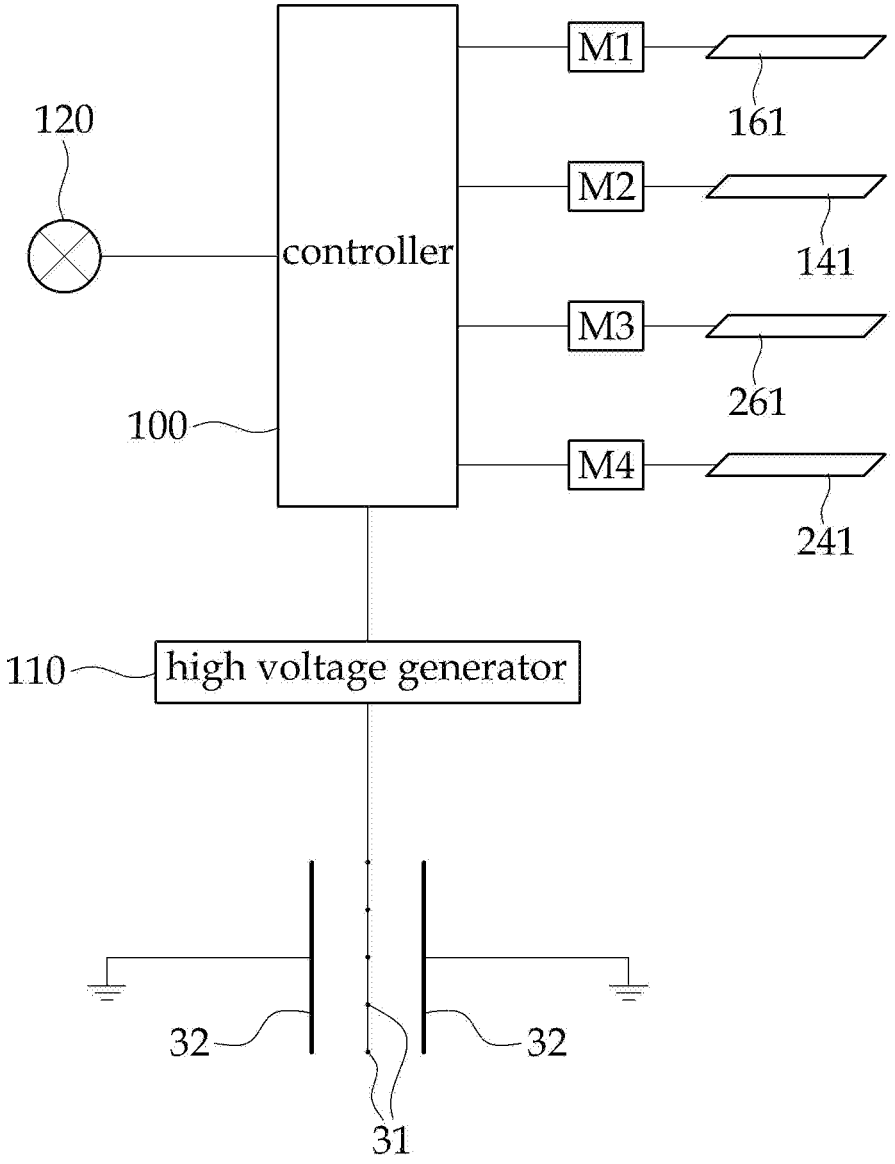
FIG. 5 is a block diagram of an electrostatic precipitator integrated with a double-skin facade of a building according to the present invention.

As shown in FIGS. 1 and 5, a first opening and closing blade 161 is rotatably installed in the outer lower opening 16, thereby allowing an amount of opening of the outer lower opening 16 to be adjusted, and the first opening and closing blade 161 is designed to be operated to rotate by driving of a first servo motor M1, thereby adjusting the amount of opening of the outer lower opening 16.

A second opening and closing blade 141 is rotatably installed in the outer upper opening 14, thereby allowing an amount of opening of the outer lower opening 14 to be adjusted, and the second opening and closing blade 141 is designed to be operated by driving of a second servo motor M2, thereby adjusting the amount of opening of the outer upper opening 14.

A third opening and closing blade 261 is rotatably installed in the inner lower opening 26, thereby allowing an amount of opening of the outer lower opening 26 to be adjusted, and the third opening and closing blade 261 is designed to be operated by driving of a third servo motor M3, thereby adjusting the amount of opening of the inner lower opening 26.

A fourth opening and closing blade 241 is rotatably installed in the inner upper opening 24, thereby allowing an amount of opening of the outer lower opening 24 to be adjusted, and the fourth opening and closing blade 241 is designed to be operated by driving of a fourth servo motor M4, thereby adjusting the amount of opening of the inner upper opening 24.

Here, a plurality of first, second, third, and fourth opening and closing blades 161, 141, 261, and 241, respectively, is installed and is interlocked with each other, and is operated to rotate by the corresponding servomotors M1 to M4.

Meanwhile, as shown in FIG. 5, the first, second, third, and fourth servo motors M1, M2, M3, and M4, respectively, are electrically connected to a controller 100, whereby rotational driving thereof is controlled. The controller 100 is electrically connected to a high voltage generator 110 that is for applying a high voltage to the discharge electrode 31. In an electrostatic precipitation mode, while performing ventilation to induce an ascending air current to the hollow layer C, the controller 100 performs electrostatic precipitation. That is, in the electrostatic precipitation mode, the controller 100 controls driving of the second and third servo motors M2 and M3, thereby allowing the second and third opening and closing blades 141 and 261 to operate to be closed by rotation so that the outer upper opening 14 and the inner lower opening 26 are closed. At the same time, in order for the outer lower opening 16 and the inner upper opening 24 to be kept open by the blades 161 and 241 being operated to rotate, driving of the first and fourth servo motors M1 and M4 is controlled.

Therefore, in the electrostatic precipitation mode, as the ascending air current is generated due to generation of buoyancy that is caused by the external wind pressure or the temperature rise inside the hollow layer C, as shown in FIG. 3, outside air flows in through the outer lower opening 16, passes through the inside of the hollow layer C, and is then introduced into the room through the inner upper opening 24, thereby allowing precipitation ventilation to be realized. In this process, the controller 100 causes a high voltage to be generated at the discharge electrode 31 through the high voltage generator 110 in the electrostatic precipitation mode, thereby allowing precipitation to be performed on dust collecting electrodes 32.

Here, the controller 100 may be connected to a fine dust concentration measurement sensor 120 measuring concentration of external fine dust and may allow the electrostatic precipitation mode to be executed when concentration equal to or higher than a predetermined concentration is confirmed. At this time, appropriate discharge voltage may be controlled according to the concentration value of the fine dust.

On the other hand, in a general ventilation mode, the controller 100 controls the discharge interruption in order to stop the discharge of the discharge electrode 31 and controls driving of the second and third servo motors M2 and M3 in order to keep the outer upper opening 14 and the inner lower opening 26 fully open by opening the closed second and third opening and closing blades 141 and 261. Naturally, at this time, in order to keep the outer lower opening 16 and the inner upper opening 24 open, driving of the first servo motor M1 and the fourth servo motor M4 is controlled. Therefore, in the general ventilation mode, ventilation may be performed such that the outside air is introduced into the room through the outer lower opening 16 and the inner lower opening 26, and then discharged to the outside through the inner upper opening 24 and the outer upper opening 14.

An example of operation of the electrostatic precipitator integrated with a double-skin facade of a building configured as described above will be described by dividing into a general ventilation mode and an electrostatic precipitation mode.

First, in the general ventilation mode, the controller 100 stops discharge of the discharge electrode 31 and opens the closed second and third opening and closing blades 141 and 261 by controlling driving of the second and third servo motors M2 and M3. Therefore, the outer upper opening 14 and the inner lower opening 26 are fully open.

Figure 4:
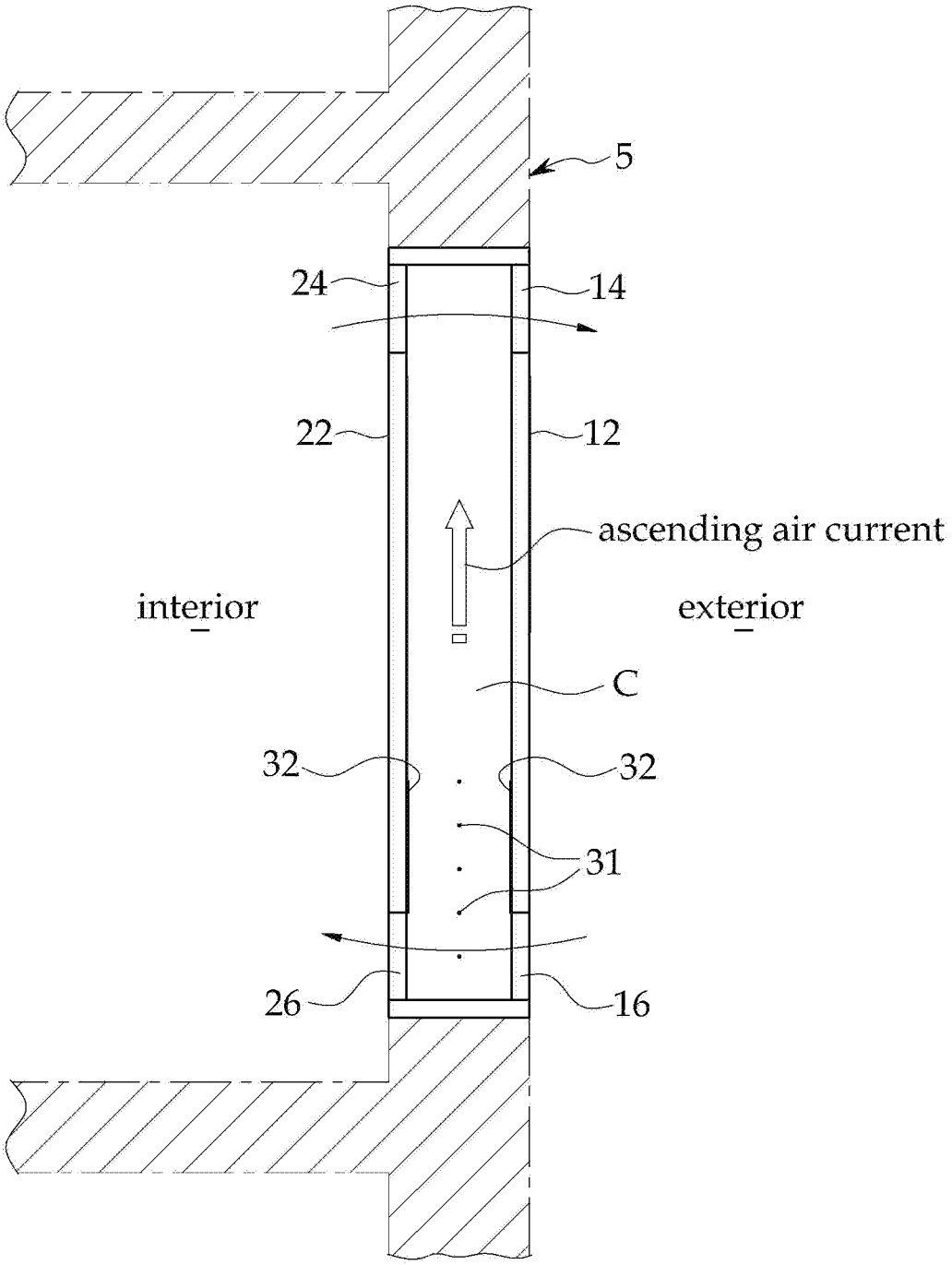
FIG. 4 is a view of a ventilation state in a general ventilation mode in the double-skin facade of the building of FIG. 1.

Of course, at this time, the outer lower opening 16 and the inner upper opening 24 are in an open state. Therefore, as shown in FIG. 4, ventilation is performed such that the outside air is introduced into the room through the outer lower opening 16 and the inner lower opening 26, and then vented to the outside through the inner upper opening 24 and the outer upper opening 14, whereby ventilation is performed.

In the electrostatic precipitation mode, the controller 100 performs electrostatic precipitation while performing ventilation to allow the ascending air current to be induced to the hollow layer C. That is, in the electrostatic precipitation mode, the controller 100 drives the second and third servo motors M2 and M3 to operate the second and third opening and closing blades 141 and 261 to rotate to be closed, whereby the outer upper opening 14 and the inner lower opening 26 are closed. At the same time, the first and fourth servo motors M1 and M4 are driven to operate the first and fourth opening and closing blades 161 and 241 to rotate, thereby opening the outer lower opening 16 and the inner upper opening 24.

Therefore, as shown in FIG. 3, as the ascending air current is generated due to the generation of the buoyancy caused by the external wind pressure or the temperature rise inside the hollow layer C, the precipitation ventilation is performed such that the outside air flows in through the outer lower opening 16, passes through the inside of the hollow layer C, and is then introduced into the room through the inner upper opening 24. Therefore, the external fine dust is precipitated in advance in the hollow layer C provided between the outer window 12 and the inner window 22, thereby being effectively prevented from entering the room.

Therefore, the electrostatic precipitator integrated with the double-skin facade of the building of the present invention may be used in old buildings, school facilities, day care centers, and the like, which require natural ventilation when installation of mechanical facilities is difficult, as well as apartment houses and may be usefully applied as a technology to block the inflow of the fine dust to an indoor room to which the window may be attached including a living room and a room by implementing the window module.

So far, the present invention has been described in detail with reference to the presented embodiments, but those skilled in the art may make various variations and modifications without departing from the technical spirit of the present invention with reference to the presented embodiment. The present invention is not limited by an invention of such variations and modifications and is limited only by the claims appended hereto.

What is claimed is:

1. An electrostatic precipitator integrated with a double-skin facade of a building, the precipitator comprising:

an outer window (12) installed at an outdoor side of the building by being made of an outer glass window frame (121) and an outer glass (122);

an outer upper opening (14) and an outer lower opening (16) installed at upper and lower portions, respectively, of the outer window (12) for indoor ventilation;

an inner window (22) providing a hollow layer (C) between the inner window (22) and the outer window (12) by being installed at a room side facing the outer window (12) at a regular interval by being made of an inner glass window frame (221) and an inner glass (222);

an inner upper opening (24) and an inner lower opening (26) installed at upper and lower portions, respectively, of the inner window (22), for ventilation;

at least one discharge electrode (31) charging particles introduced into the hollow layer (C) through the outer lower opening (16) by being installed in the hollow layer (C) and by being controlled to an appropriate voltage strength according to external wind pressure and fine dust concentration; and dust collecting electrodes (32) precipitating charged particles by being installed in contact with the hollow layer (C) on surfaces, respectively, of the outer glass (122) and the inner glass (222).

2. The electrostatic precipitator of claim 1, further comprising:

a first opening and closing blade (161) rotatably installed in the outer lower opening (16), thereby allowing an amount of opening of the outer lower opening (16) to be adjusted and a first servo motor (M1) adjusting an amount of opening of the outer lower opening (16) by operating the first opening and closing blade (161) to rotate;

a second opening and closing blade (141) rotatably installed in the outer upper opening (14), thereby allowing an amount of opening of the outer upper opening (14) to be adjusted and a second servo motor (M2) adjusting an amount of opening of the second opening and closing blade (141);

a third opening and closing blade (261) rotatably installed on the inner lower opening (26), thereby allowing an amount of opening of the inner lower opening (26) to be adjusted and a third servo motor (M3) adjusting opening and closing and an amount of rotation of the third opening and closing blade (261);

a fourth opening and closing blade (241) rotatably installed on the inner upper opening (24), thereby allowing an amount of opening of the inner upper opening (24) to be adjusted and a fourth servo motor (M4) adjusting opening and closing and an amount of rotation of the fourth opening and closing blade (241); and a controller (100), in an electrostatic precipitation mode, allowing precipitation ventilation to be realized due to ascending air current generated in the hollow layer (C), by closing the outer upper opening (14) and the inner lower opening (26) by controlling driving of the second and third servo motors (M2 and M3) to operate the second and third opening and closing blades (141 and 261) to rotate and, at the same time, by opening the outer lower opening (16) and the inner upper opening (24) by controlling driving of the first and fourth servo motors (M1 and M4) to operate the first and fourth opening and closing blades (161 and 241) to rotate and allowing precipitation to be realized on dust collecting electrodes (32) by causing a high voltage to be generated at the at least one discharge electrode (31).

3. The electrostatic precipitator of claim 2, wherein, in a general ventilation mode, the controller (100) stops discharge of the at least one discharge electrode (31) and allows the outer upper opening (14) and the inner lower opening (26) to be fully opened by opening the second and third opening and closing blades (141 and 261) by controlling driving of the second and third servo motors (M2 and M3).

4. The electrostatic precipitator of claim 2, wherein the controller (100) is connected to a fine dust concentration measurement sensor (120) measuring concentration of external fine dust and executes the electrostatic precipitation mode when the concentration equal to or higher than a predetermined concentration is confirmed.

5. The electrostatic precipitator of claim 1, wherein the at least one discharge electrode (31) is provided in plural, the plurality of discharge electrodes being installed adjacent to the outer lower opening (16) and in parallel with each other.

* * * * *